US008651898B2

(12) United States Patent
Duan et al.

(10) Patent No.: US 8,651,898 B2
(45) Date of Patent: Feb. 18, 2014

(54) CONNECTOR MODULE WITH PERSISTENT CONTACT FORCE

(75) Inventors: Shu-Lin Duan, New Taipei (TW); Sheng-Chan Lin, New Taipei (TW); Wei Wan, New Taipei (TW); Pei-Hsuan Huang, New Taipei (TW)

(73) Assignee: Advanced-Connectek Inc., New Taipei City (TW)

( * ) Notice: Subject to any disclaimer, the term of this patent is extended or adjusted under 35 U.S.C. 154(b) by 11 days.

(21) Appl. No.: 13/609,964

(22) Filed: Sep. 11, 2012

(65) Prior Publication Data

US 2013/0217268 A1 Aug. 22, 2013

(30) Foreign Application Priority Data

Feb. 17, 2012 (CN) ..... 2012 2 0051795 U

(51) Int. Cl.
*H01R 13/627* (2006.01)
*H01R 33/00* (2006.01)

(52) U.S. Cl.
USPC ..... 439/660; 439/350

(58) Field of Classification Search
USPC ..... 439/350.352, 357, 660
See application file for complete search history.

(56) References Cited

U.S. PATENT DOCUMENTS

| | | | | |
|---|---|---|---|---|
| 5,697,816 | A * | 12/1997 | Wu | 439/660 |
| 6,247,948 | B1 * | 6/2001 | Davis et al. | 439/188 |
| 7,273,390 | B2 * | 9/2007 | Iida et al. | 439/494 |
| 7,275,968 | B1 * | 10/2007 | Chiang | 439/660 |
| 8,043,109 | B2 * | 10/2011 | Bishop et al. | 439/357 |

* cited by examiner

*Primary Examiner* — Khiem Nguyen
(74) *Attorney, Agent, or Firm* — Rabin & Berdo, P.C.

(57) ABSTRACT

A connector includes an insulated body with a slot to receive therein a terminal module and a casing entirely enclosing the insulated body. An arm has at least two extensions respectively adapted to two oppositely formed sidewalls of the insulated body and each is provided with a boss formed on a distal end of the at least two extensions. At least two through holes are adapted to be defined in each of the two sidewalls of the insulated body to receive therein the bosses.

10 Claims, 4 Drawing Sheets

CONNECTOR MODULE WITH PERSISTENT CONTACT FORCE

CROSS-REFERENCE TO RELATED APPLICATION

This application claims priority from application No. 201220051795.5, filed on Feb. 17, 2012 in the State Intellectual Property Office of The People's Republic of China.

FIELD OF THE INVENTION

The invention relates to a connector module, and more particularly to a connector module having a persistent contact force with other electronic devices.

BACKGROUND OF THE INVENTION

Due to the increasing development of technology, all kinds of electronic devices overwhelmingly exist in our daily routines. Among these electronic devices, the Universal Serial Bus (USB) is one of the most used devices for its plug-in feature and normally has an insulated body, a terminal module received in the insulated body and a casing enclosing the insulated body.

To maintain good contact with other electronic devices, the casing usually has four sidewalls each provided with a clamping device with an arm extending outward from the clamping device and a boss formed on a distal end of the arm so that when other electronic devices are to contact the USB, the bosses are able to clamp other devices and allow other electronic devices to electrically connect to the terminal module inside the insulated body.

Because the arms are integral parts of the casing, after numerous use of the arms as well as the bosses, metal fatigue occurs in the arms and thus the clamping force of the USB to other electronic devices weakens, which may easily lead to loose connection therebetween and even faulty signal transmission.

SUMMARY OF THE INVENTION

The primary objective of the present invention is to provide an improved connector having a durable and persistent contact force with other electronic devices.

In order to accomplish the aforementioned objective, the connector of the present invention is composed of an insulated body, at least one arm and a casing. The insulated body has a slot defined for receiving therein a terminal module and at least one through hole defined in two opposite sidewalls of the insulated body. The arm is L shaped to structurally correspond to two oppositely formed sidewalls of the insulated body and has two extensions integrally formed with the arm to structurally correspond to the two oppositely formed sidewalls of the insulated body and at least one boss formed on a distal end of the extensions to correspond to the through hole of the insulated body.

Another objective of the present invention is that the insulated body has two paths formed on the two oppositely formed sidewalls to correspond to the two extensions of the arm to allow the two extensions to be respectively received in the paths.

Another objective of the present invention is that the arm is U shaped and has at least three extensions of which two of the extensions are received in the paths. The insulated body has at least three through holes defined in three adjacent sidewalls thereof to allow the bosses formed on the distal ends of the three extensions of the arm to extend there through.

Still another objective of the present invention is that the arm is O shaped and has at least four extensions each provided with a boss formed on a respective distal end thereof to extend through corresponding through holes of the sidewalls of the insulated body.

Another objective of the present invention is that the casing has a contact arm integrally formed on a sidewall thereof for engagement with a ground of other electronic devices.

DETAILED DESCRIPTION OF THE INVENTION

In order to describe details of the preferred embodiment of the present invention, description of the structure, and the application as well as the steps are made with reference to the accompanying drawings. It is learned that after the description, any variation, modification or the like to the structure and the steps of the embodiments of the preferred embodiment of the present invention is easily made available to any person skilled in the art. Thus, the following description is only for illustrative purpose only and does not, in any way, try to limit the scope of the present invention.

Figure 1:
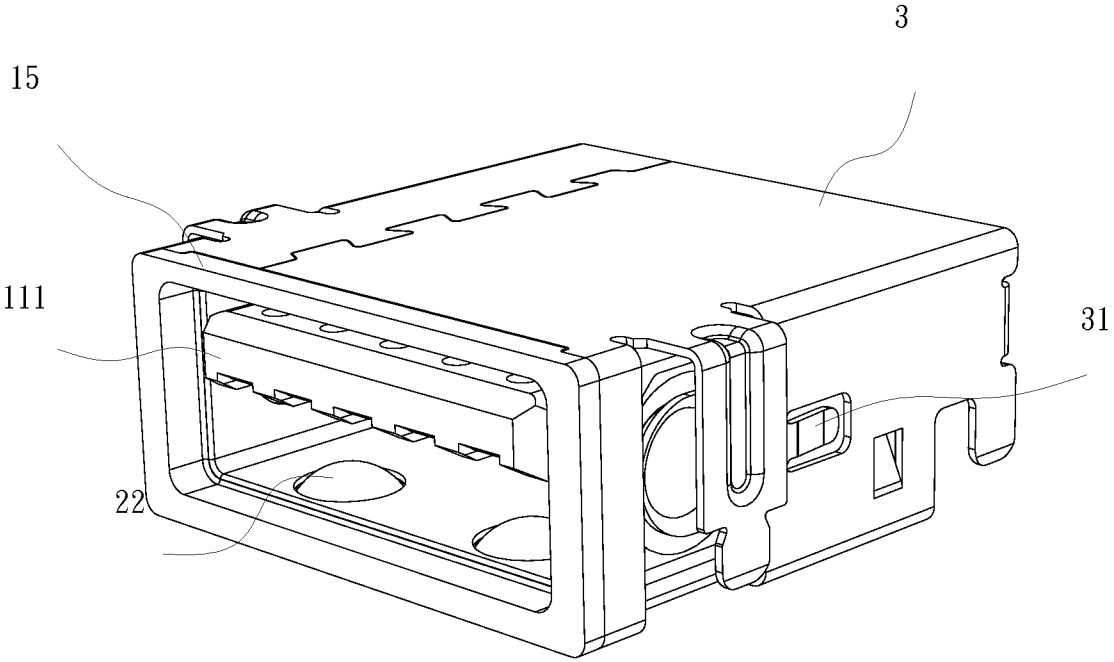
FIG. 1 is a perspective view showing the connector constructed in accordance with the present invention.
Figure 2:
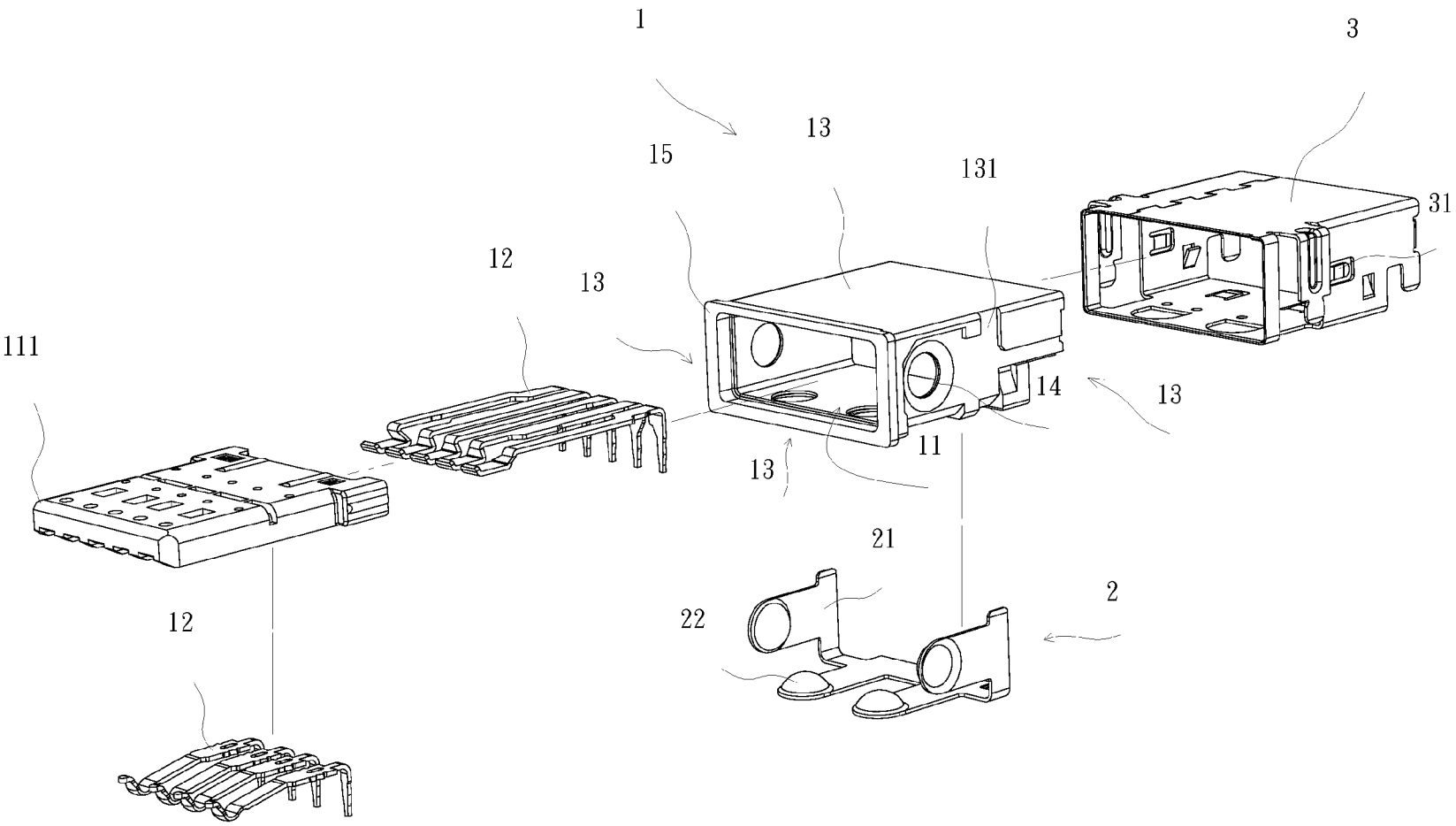
FIG. 2 is an exploded perspective view of the connector in FIG. 1.

With reference to FIGS. 1 and 2 of the preferred embodiment of the present invention, it is noted that the connector constructed in accordance with the present invention is composed of an insulated body 1, at least an arm 2 and a casing 3.

The insulated body 1 has a slot 11 defined for receiving therein a terminal module 12 and has four sidewalls 13 formed to enclose the slot 11 of which two oppositely formed sidewalls 13 respectively have a path 131 formed thereon and at least a through hole 14 defined in two oppositely formed sidewalls 13 and a flange 15 formed on a peripheral edge of the slot 11 and having a thickness thicker than that of the sidewall 13 so that when the insulated body 1 is assembled with the casing 3, no part of the casing 3 is revealed from the outside.

Furthermore, a receptacle 111 may be provided to receive therein the terminal module 12 and then the receptacle 111 and the terminal module 12 as a whole is received in the slot 11 of the insulated body 1.

The arm 2 has at least two extensions 21 extending outward to correspond to the two paths 131 of the two oppositely formed sidewalls 13 of the insulated body 1 and each having a boss 22 formed on distal end thereof to correspond to the two through holes 14 of the sidewalls 13 of the insulated body 1. When required, the number of the extension 21 may be increased to strengthen structural feature of the present invention. That is, when the through holes 14 are defined in three adjacent sidewalls 13, there are at least three extensions 21 formed on the arm 2 and each extension 21 has a boss 22 formed on a distal end of the extension 21 to correspond to each of the through holes 14 in the sidewalls 13.

In a preferred embodiment of the present invention, it is to be noted that the casing 3 has at least one contact arm 31 integrally formed on a sidewall of the casing 3 to engage with the arm 2. The casing 3 is entirely enclosing the insulated body 1 and the arm 2 to ensure that the electromagnetic interference and noises are isolated from interfering with the terminal module 12. Further, the contact arm 31 of the casing 3 is provided for engagement with the ground terminal of other electronic devices to ensure that other electronic devices are perfectly grounded.

Figure 3:
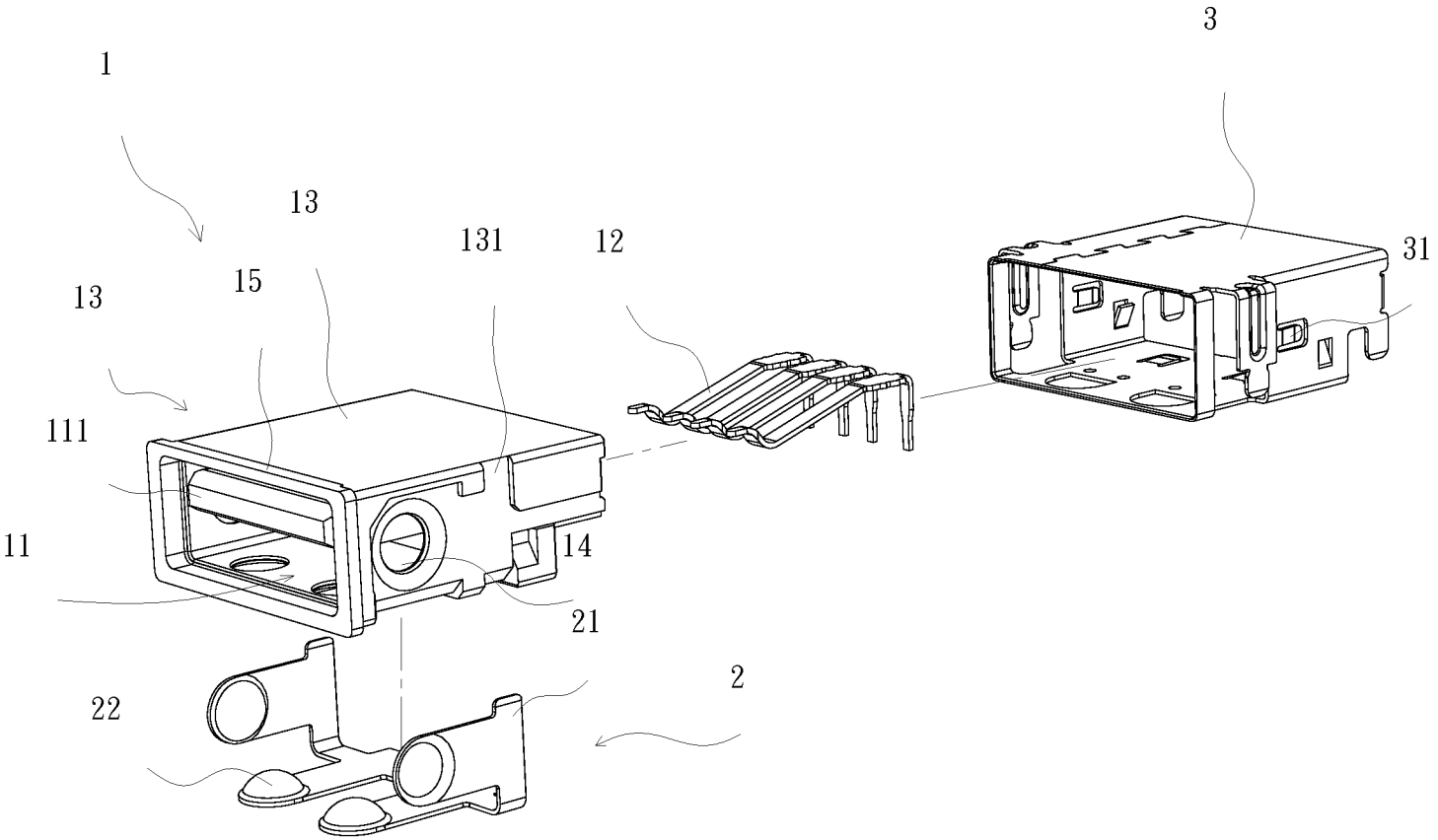
FIG. 3 is an exploded perspective view showing the application of the present invention in USB2.0.
Figure 4:
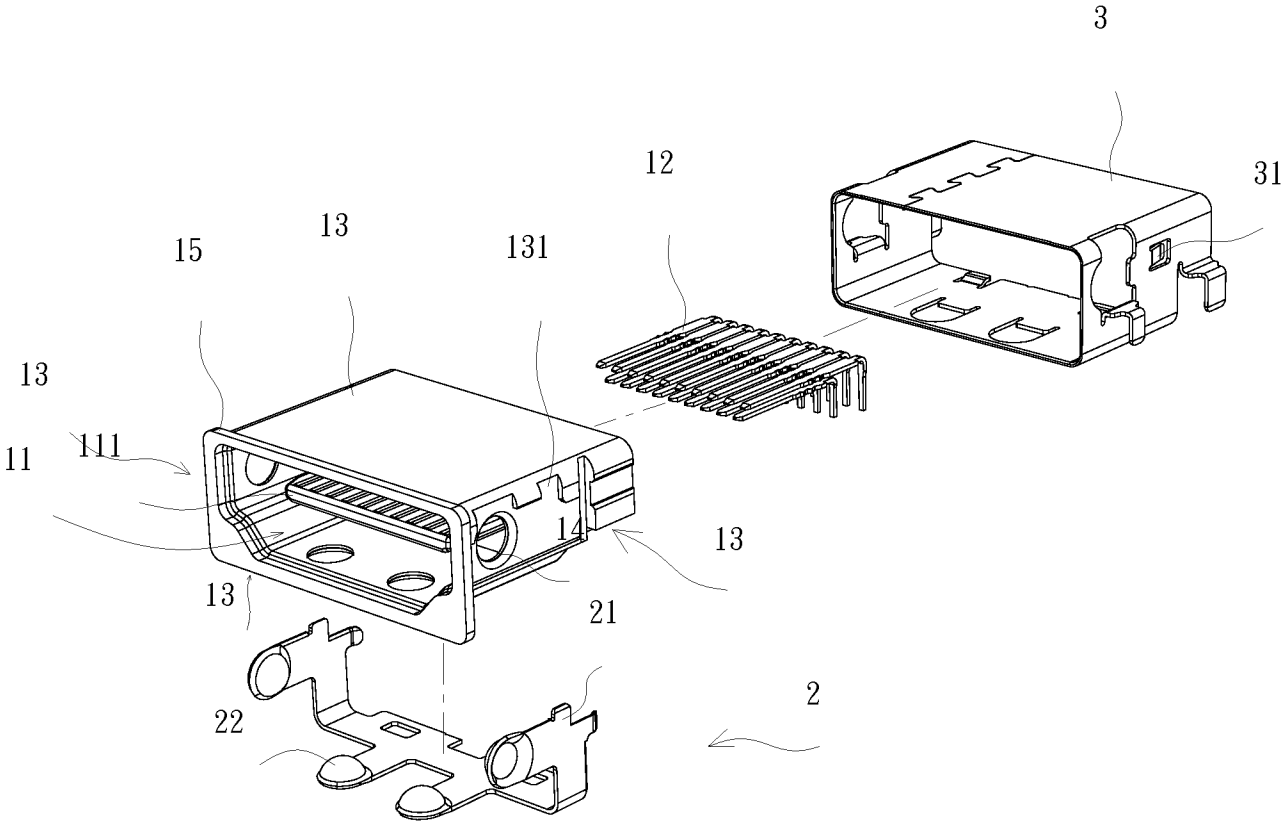
FIG. 4 is an exploded perspective view showing the application of the present invention in HDMI.

With reference to FIGS. 3 and 4, the application of the connector of the present invention to different currently existing connector modules, it is learned that when the invention is applied to either USB 2.0 or HDMI, the connector module also has an insulated body 1, at least one arm 2 and a casing 3. All other elements are substantially the same and detailed description of how the at least one arm 2 is applied is thus omitted for brevity.

From the above description, it is noted that the clamping force to persistently applying a constant force to maintain the other electronic device in tight contact with the connector of the present invention comes an isolated element, the arm, rather an integral part of the body such that the structural integrity is not influenced by the condition of the body.

While the invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. In a connector having an insulated body with a slot to receive therein a terminal module and a casing entirely enclosing the insulated body, wherein the improvements comprise:

an arm with at least two extensions respectively adapted to two oppositely formed sidewalls of the insulated body and each having a boss formed on a distal end of the at least two extensions; and at least two through holes adapted to be defined in each of the two sidewalls of the insulated body to receive therein the bosses.

2. The connector as claimed in claim 1, wherein a receptacle is provided to receive therein the terminal module and received in the slot of the insulated body together with the terminal module.

3. The connector as claimed in claim 1, wherein at least two paths are adapted to be defined in the two oppositely formed sidewalls of the insulated body to receive therein the at least two extensions of the arm.

4. The connector as claimed in claim 2, wherein at least two paths are adapted to be defined in the two oppositely formed sidewalls of the insulated body to receive therein the at least two extensions of the arm.

5. The connector as claimed in claim 1, wherein three through holes are adapted to be defined in the two oppositely formed sidewalls and three extensions are formed on the arm with each extension having the boss formed on the distal end thereof to correspond to the three through holes of the sidewalls.

6. The connector as claimed in claim 2, wherein three through holes are adapted to be defined in the two oppositely formed sidewalls and three extensions are formed on the arm with each extension having the boss formed on the distal end thereof to correspond to the three through holes of the sidewalls.

7. The connector as claimed in claim 3, wherein three through holes are adapted to be defined in the two oppositely formed sidewalls and three extensions are formed on the arm with each extension having the boss formed on the distal end thereof to correspond to the three through holes of the sidewalls.

8. The connector as claimed in claim 4, wherein three through holes are adapted to be defined in the two oppositely formed sidewalls and three extensions are formed on the arm with each extension having the boss formed on the distal end thereof to correspond to the three through holes of the sidewalls.

9. The connector as claimed in claim 5, wherein three through holes are adapted to be defined in the two oppositely formed sidewalls and three extensions are formed on the arm with each extension having the boss formed on the distal end thereof to correspond to the three through holes of the sidewalls.

10. The connector as claimed in claim 1, wherein the casing further has a contact arm adapted to be formed for contact with ground.

* * * * *